United States Patent [19]

Koch

[11] 4,440,003

[45] Apr. 3, 1984

[54] APPARATUS FOR WET TREATMENT OF A LENGTH OF TEXTILE MATERIAL IN HANK FORM

[75] Inventor: Werner Koch, Wald-Michelbach, Fed. Rep. of Germany

[73] Assignee: Bruckner Apparatebau GmbH, Fed. Rep. of Germany

[21] Appl. No.: 412,072

[22] Filed: Aug. 27, 1982

[30] Foreign Application Priority Data

Sep. 29, 1981 [DE] Fed. Rep. of Germany ..... 3138672

[51] Int. Cl.[3] ..... D06B 3/26; D06B 23/02

[52] U.S. Cl. ..... 68/22 R; 68/176; 68/177

[58] Field of Search ..... 68/176, 178, 62, 22 R, 68/177, 27; 8/151, 152; 226/26, 118

[56] References Cited

U.S. PATENT DOCUMENTS

| | | | |
|---|---|---|---|
| 2,797,086 | 6/1957 | Cohn et al. | 226/26 |
| 3,875,769 | 4/1975 | Inoue | 68/176 |
| 3,971,236 | 7/1976 | Bene | 68/176 |
| 4,104,753 | 8/1978 | Schuierer | 8/152 |
| 4,107,801 | 8/1978 | Tachibana | 68/176 X |

*Primary Examiner*—Philip R. Coe

*Attorney, Agent, or Firm*—Learman & McCulloch

[57] ABSTRACT

Apparatus for the wet treatment of lengths of textile material in hank form has a plurality of chambers through which the lengths of material pass in succession and transport means which convey the length of material. To enable more or less elastic types of material to be subjected to wet treatment under desired uniform treatment conditions, the quantities of material contained in the individual chambers are monitored by sensing devices which control the rate at which the material is conveyed by the transport means.

13 Claims, 5 Drawing Figures

APPARATUS FOR WET TREATMENT OF A LENGTH OF TEXTILE MATERIAL IN HANK FORM

BACKGROUND OF THE INVENTION

The invention relates to apparatus for wet treatment of a length of textile material in hank form, the apparatus having a plurality of chambers through which the length of material passes in succession as well as transport means arranged between the individual chambers to convey the length of material.

Apparatus of the aforementioned type is used in particular for wet finishing of lengths of textile material. The treatment area, whether open or closed, can be divided into individual chambers particularly in its lower portion in such a way that the length of material passes substantially spirally through the whole treatment area or the whole apparatus. For such treatment the chambers preferably are so constructed that the length of material can rest in each chamber for a specific period of time, thereby producing particularly good results from the wet treatment.

However, difficulties occur with the known apparatus if a specific resting time for the length of material is to be set in each chamber. It may be assumed that once a particular degree of filling has been set in each chamber for a specific type of material this could always be maintained approximately uniformly if the same quantity of material is removed from each chamber as was introduced. However, this can only be achieved with lengths of material which are completely lacking in elasticity and do not change in any way under the different treatment conditions. In practice, wet treatment is used predominantly for more or less elastic lengths of material which are subject to varying stretching effects, depending upon the treatment temperature and the concentrations in the treatment fluid, so that variations in the load in the individual chambers occur in the course of a long wet treatment, resulting in undesirable fluctuations in the results of the treatment.

SUMMARY OF THE INVENTION

The object of the invention is to provide apparatus of the type referred to which can be set to a specific load, but which can alter the respective load as desired in the course of the wet treatment or adapt it to other requirements.

This object is achieved according to the invention by the provision of devices in the individual chambers which monitor the quantities of material contained in the individual chambers and which control the transport means so as to influence the quantities of material as desired.

Thus, in the apparatus according to the invention, if the load in one or several chambers alters in the course of the treatment as a result of differing stretching effects then at least one of the transport means (or the appropriate number thereof) can be controlled by corresponding devices so that the desired condition in such chamber or chambers is restored. In this way an extremely even wet treatment of the length of textile material is ensured in each case in the course of a long wet treatment phase.

According to one embodiment of the apparatus each chamber can have filling level indicators for the maximum and minimum load so that the transport means can be controlled both in the case of overfilling and in the case of underfilling of at least one chamber so that the quantity of material can be influenced as desired.

In another embodiment of the apparatus each chamber is equipped according to the invention with weighing means to monitor the maximum and minimum load. With such a construction the operation of the apparatus can be accurately adapted to the weight per metre run of the material. It is, of course, taken into account that the weight of material is influenced by the treatment fluid present in each chamber, by the type of material itself, by the temperature, and by chemicals and the like. However, these are values which can be very quickly determined.

DESCRIPTION OF THE DRAWINGS

Further details of the invention are disclosed in the following description of several embodiments illustrated in the accompanying drawings, in which.

DETAILED DESCRIPTION

Figure 1:
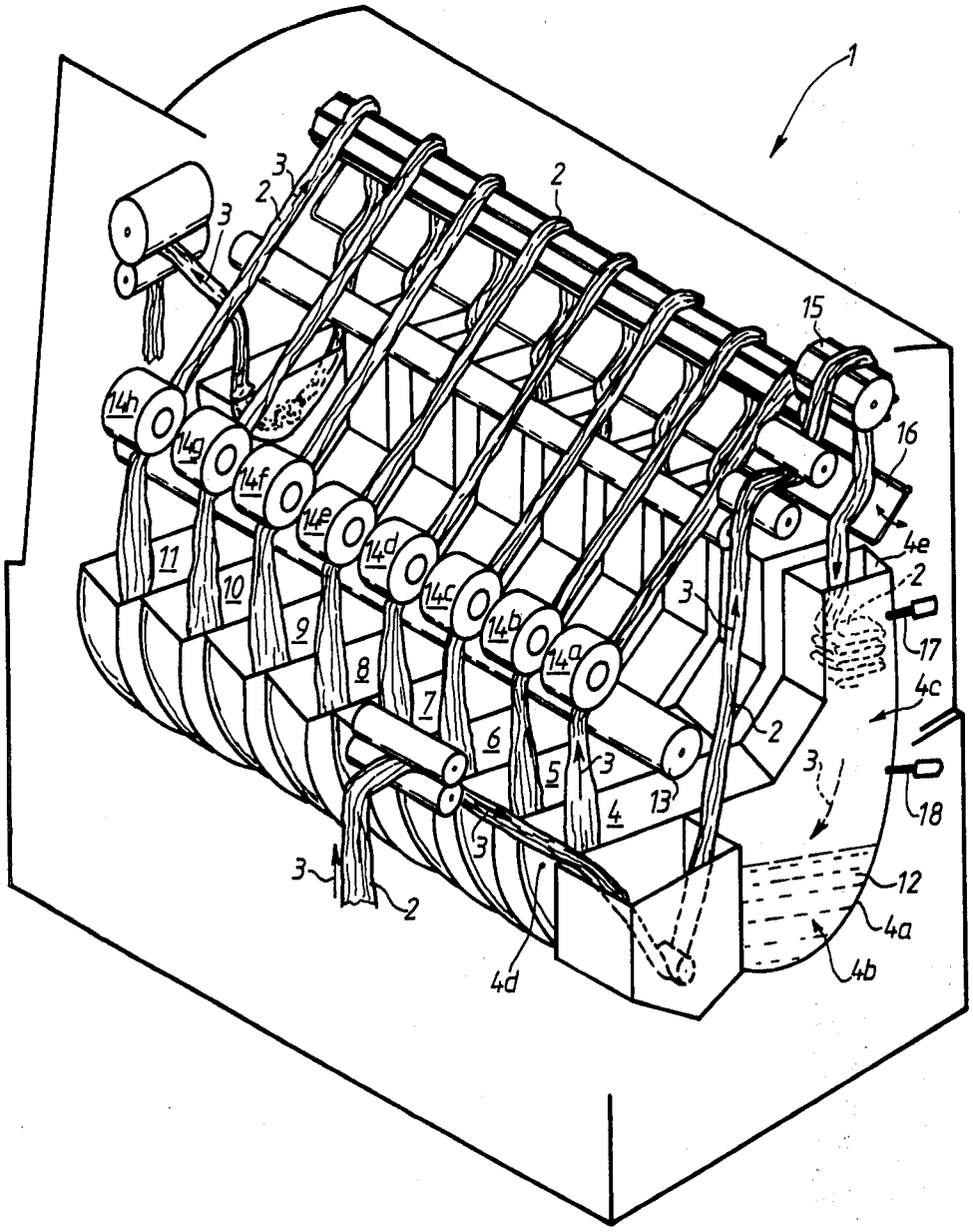
FIG. 1 is a simplified, perspective view of one embodiment of wet treatment apparatus with filling level indicators for the load in each chamber.

The wet treatment apparatus 1 illustrated in FIG. 1 includes only those parts essential for explanation of the invention, while drive means, shafts, bearings etc., well-known in the art, are not shown for the sake of clarity.

The apparatus 1 serves for wet treatment of a length of textile material 2 in hank form which is conveyed in succession approximately spirally in the direction of the arrow 3 through a number of chambers 4–11. In the illustrated case there are eight chambers which are directly connected to each other, side by side. Each of the chambers 4–11 can be provided in a conventional manner with a concave base e.g., 4*a*, and, as shown in FIG. 1, can be constructed in the shape of a boot or in any other suitable shape. Each chamber 4–11 has a lower part filled with a treatment fluid 12 and a resting area, e.g., 4*c* in chamber 4, which extends opposite to the direction of conveyance (arrow 3) and in which the incoming length of material 2 can rest for a specific period of time before it enters the treatment fluid 12.

Above the chambers 4–11 the apparatus 1 contains transport means which convey the length of material 2 between the individual chambers 4–11. In the embodiment of FIG. 1, above each outlet end, e.g., 4*d*, for the length of material from each chamber 4–11 there is a pair of squeeze rollers which is formed in each case by a continuous lower roller 13 common to all chambers 4–11 and a separate upper squeeze roller 14*a*–14*h* associated with each chamber 4–11. As will be explained below in connection with FIG. 2, each of the upper squeeze rollers 14*a*–14*h* can be controlled separately and lifted individually from the lower roller 13 so that the with-drawal of the hank of material 2 from the respective chamber can be disabled. Above the inlet end for the length of material, e.g., 4e, of each chamber 4–11 the transport means includes a driven guide roller or reel 15 and a known pivotable pleating frame 16 arranged below it so that the length of material 2 entering the respective chamber, e.g. 4, can be let down in pleats, as indicated in dash lines in chamber 4.

In the region of the resting zone 4c of the first chamber 4 known filling level indicators 17 and 18 are provided. Such filling level indicators 17 and 18 are associated with each of the chambers 4–11; in each case they indicate the maximum (indicator 17) or the minimum (indicator 18) load which is then passed to a known system operable to control the transport means in a manner to be described.

The individual chambers 4–11 and the quantities of material contained therein can be monitored by means of the filling level indicators 17, 18. If an indicator shows that the load in a specific chamber or several chambers is too small or too great, then at least one of the upper squeeze rollers 14 will be lifted by the control system (or manually) from the lower roller 13 and the length of material between such two rollers so that withdrawal of material from such specific chamber is interrupted if the load in the chamber below is too low or the load in the succeeding chamber is too high. In a similar manner, all upstream or downstream chambers, viewed in the direction of conveyance (arrow 3), can gradually have their load reset as is necessary or desired for the respective wet treatment.

If required, all the chambers 4–11 of the wet treatment apparatus 1 can contain substantially the same treatment fluid, but it also is possible to provide a different treatment fluid in each chamber 4–11. Since there is a pair of squeeze rollers above each outlet, e.g., 4d, for the length of material, the fluid taken up by the length of material 2 can be thoroughly squeezed out and returned to the corresponding chamber. The length of material 2 is conveyed further in each case by pressure of the upper squeeze roller 14a–14h on the continuous lower roller 13, only the lower roller 13 being driven.

The period of dwell of the length of material 2 in each chamber can be influenced or altered as desired by the aforesaid facility of controlling the transport means via the filling level indicators 17, 18 in the individual chambers. Thus, if the quantity of material and with it the filling level in one chamber or in several chambers alter for example as a result of stretching, then this condition is displayed within justifiable limits or in a desired manner by the filling level indicators 17, 18 whereupon at least one corresponding pair of squeeze rollers is controlled in order to have the necessary influence on the quantity of material, for example by raising the upper squeeze roller and thus interrupting the corresponding conveyance of material.

This wet treatment apparatus 1 can be used both for continuous wet treatment of the length of material 2 and for intermittent wet treatment. In the latter case the length of material from the last downstream treatment chamber is led back into the first upstream chamber. In a continuous wet treatment there is the additional advantage that if the type of material changes it is not necessary to run the whole apparatus 1, i.e., all the chambers 4–11, empty. Instead, the wet treatment of a new type of material can immediately succeed the preceding one and the load and period of dwell can be quickly adapted to the new conditions without difficulty.

As regards the arrangement and construction of the individual chambers 4–11 it should be stated that, as can be seen from FIG. 1, these could be somewhat inclined relative to the arrangement of the pairs of squeeze rollers and the reels (in order to ensure the spiral movement) but that it is also possible to align the arrangement of the individual chambers approximately at right angles to the said transport means whenever it is necessary to provide corresponding transfer arrangements in order to ensure the spiral movement of the length of material through the apparatus.

With the aid of FIGS. 2 and 3 an embodiment of the wet treatment apparatus will now be described in which the general construction of the apparatus with the individual chambers and the transport means arranged above them can be retained substantially as shown in FIG. 1, while only the monitoring devices for the quantities of material contained in the individual chambers are of different construction. Therefore, for the sake of simplicity those parts which are similar to those already described in connection with FIG. 1 are identified by the same reference numerals with the addition of a prime.

Figure 2:
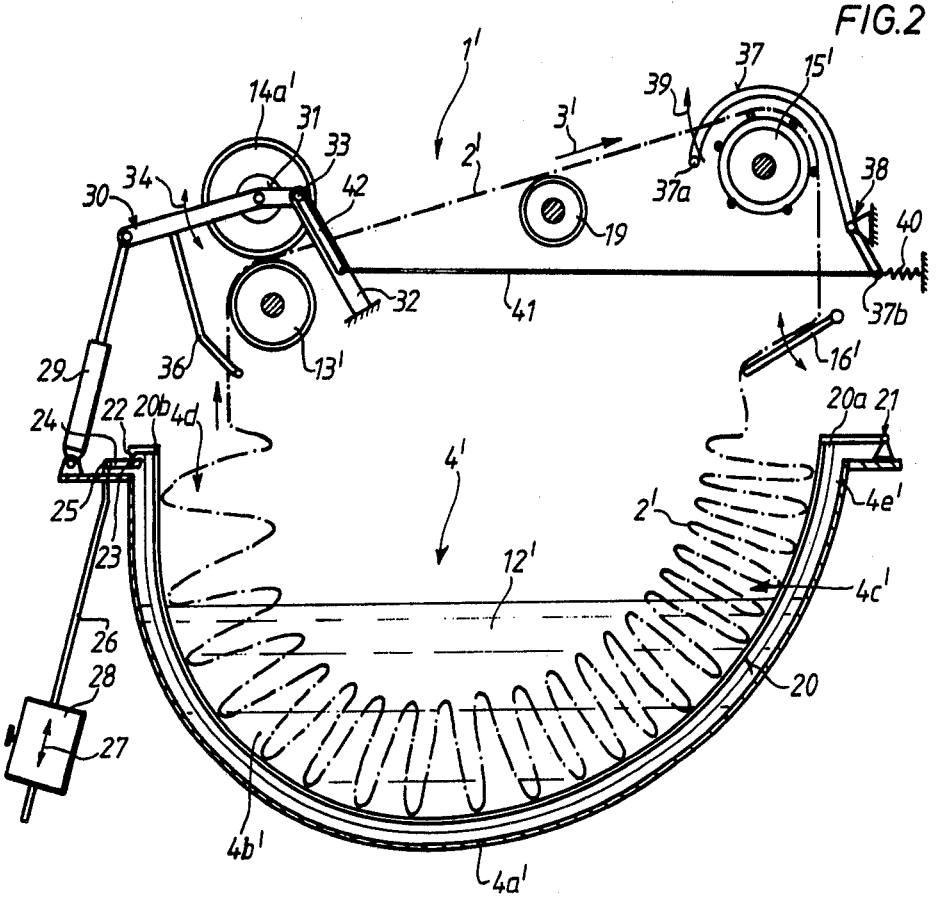
FIG. 2 is a diagrammatic cross-sectional view through apparatus which is somewhat modified in relation to that of FIG. 1 and in which each chamber is equipped with a weighing device.

As regards FIG. 2 it should be assumed that this is a cross-sectional view through the chamber 4' (corresponding to chamber 4 in FIG. 1) with the concave base 4a', the treatment fluid 12' in the lower part 4b', the resting zone 4c', the material inlet end 4e', the material outlet end 4d', and the driven continuous lower roller 13', the corresponding upper squeeze roller 14a', the driven reel 15' and the pleating frame 16'; at least one support roller 19 for the length of material 2' can optionally also be arranged in the region between the lower roller 13' and the reel 15'The length of material 2' is conveyed in the direction of the arrow 3' through the apparatus 1'.

In contrast to the example according to FIG. 1, in this case each chamber e.g., 4', is equipped with a weighing device to monitor the maximum and minimum load.

Generally speaking, such a weighing device could be directly connected to each associated chamber, but it would then be necessary for each chamber to be constructed independently of the neighboring chamber and to be movable.

In the illustrated embodiment it is therefore preferred to arrange in each chamber 4' a grate 20 which supports the length of material 2' and leads into the treatment fluid bath 12' and which is spaced from the base 4a' of the chamber along the whole base from the material inlet end 4e' to the material outlet end 4d'. In the region of the ends 4e' and 4d' of the chamber the corresponding ends 20a, 20b of the grate 20 project somewhat outwardly of the associated chamber 4'. The grate 20 is pivoted at its inlet end 20a on a pivot 21 for rising and falling movements while the outlet end 20b has a knife edge 22 with which it is supported in the socket 23 of an actuating lever arm 24 which is like a balance beam and is pivotable about a fixed hinge point 25. An outer counterbalance arm 26 with a sliding weight 28 which can be adjusted in the direction of the double arrow 27 is fixed against rotation to the lever arm 24. This counterbalance arm 26 is part of a counterbalance control system which is connected to the lever bar 30 of a shifting mechanism 31 by means of a clyinder-piston unit 29 operated by a pressure medium. This shifting mechanism is firmly supported by a support 32 which provides a fixed axis of rotation 33 about which the lever bar 30 of the shifting mechanism 31 can be pivoted in the directions of the arrow 34 by means of appropriate actuation of the cylinder-piston unit 29. As can be seen from FIG. 3, the lever bar 30 is constructed in the form of a clip which at least partially surrounds the associated upper squeeze roller 14*a*′ and in which this upper squeeze roller 14*a*′ is mounted so as to be freely rotatable about an axis 35. Thus, when the lever bar 30 of the lifting mechanism 31 is pivoted in the clockwise direction, by actuation of the cylinder-piston unit 29 as a consequence of downward movement of the grate a predetermined distance due to an increase in the weight of material on the grate the corresponding upper squeeze roller 14*a*′ is moved away from the lower roller 13′ and thus from the corresponding section of the length of material 2′ so that the gripping and thus the further conveyance of this section of material is interrupted.

To enable the conveyance of the length of material to be reliably interrupted in any case (if necessary) in the manner described above, a lifting frame 36 is preferably also associated with the lever bar 30 of the shifting mechanism 31 as an extra support means for the corresponding section of material when the corresponding upper squeeze roller 14*a*′ is raised. The lifting frame 36 can be formed in simple manner by a type of additional clip (as indicated in FIGS. 2 and 3). To prevent the length of material 2′ from being subjected to undesirable strain in the region of the reel 15′ when conveyance of the material is interrupted as described above, a material support clip 37 is also associated with the reel 15′ in the region above each associated chamber. As shown in FIG. 2, in the normal state of the apparatus 1′ the clip 37 partially encircles the periphery of the reel 15′ at a sufficient distance and has on its free end a crossbar 37*a* which extends beneath the respective section of the length of material without touching the material 2′ during normal operation. Close to its other end the clip 37 is hinged on a fixed point 38 so that it can be pivoted in the direction of the arrow 39. The end of the clip extending beyond this hinge point 38 is prestressed by a tension spring 40 which prestresses it to the normal state described above. At the same time one end of a traction rod or traction rope 41 is connected to a lever arm 42 fixed to the lever bar 30 and its opposite end is fixed to the end 37*b* of the clip on which the tension spring 40 acts, so that when the lever bar 30 is pivoted in the direction of the arrow 34 the clip 37 is also pivoted about the fixed hinge point 38 and the corresponding section of the length of material is lifted from the respective section of the reel 15′ and supported by the crossbar 37*a* of the clip 37.

Figure 3:
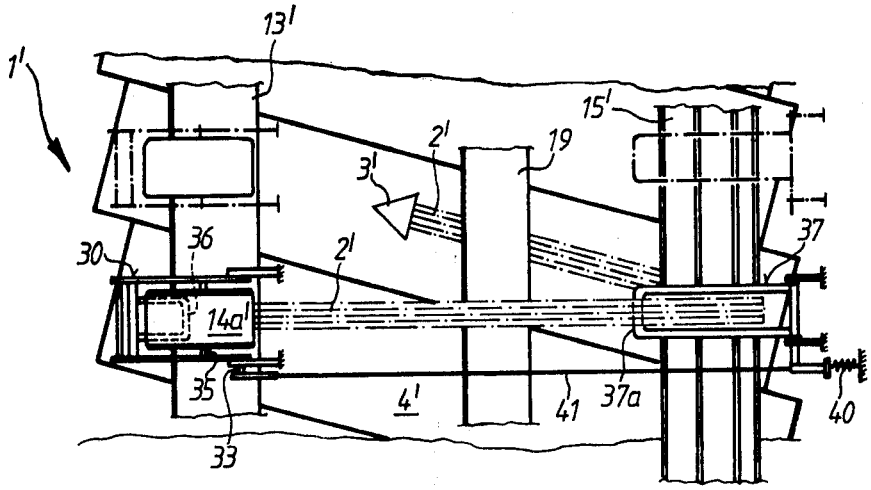
FIG. 3 is a diagrammatic partial plan view of the embodiment shown in FIG. 2.

In the embodiment according to FIGS. 2 and 3 the grate 20 supporting the length of material 2′ is suspended like a balance and is connected for control purposes to the transport means, i.e., in particular to the rollers 13′ and 14*a*′ and to the reel 15′, so that the quantities of material contained in the individual chambers, e.g. 4′, can be very accurately monitored as regards weight, and overfilling or an insufficient load in one or several chambers can be corrected extremely rapidly and to a large extent automatically by corresponding control of the transport means.

The outer counterbalance control means comprising the counterbalance arm 26 and sliding weight 28 shown in FIG. 2 can contain a zero adjustment. This zero adjustment can be easily reset or equalized as desired by adjustment of the sliding weight 28.

As regards the construction of the grate 20 it should be mentioned that basically any suitable grate can be used. A grate made from fine steel sections is acceptable, as is a grate made from sections coated with or consisting of tetrafluorethylene, or a grate can be provided which is formed at least in part by fine steel rollers. In any case, the grate 20 should ensure that the length of material 2′ entering the respective chamber is reliably supported, undergoes a certain conveying effect, and is thus passed through the treatment fluid 12′.

Figure 4:
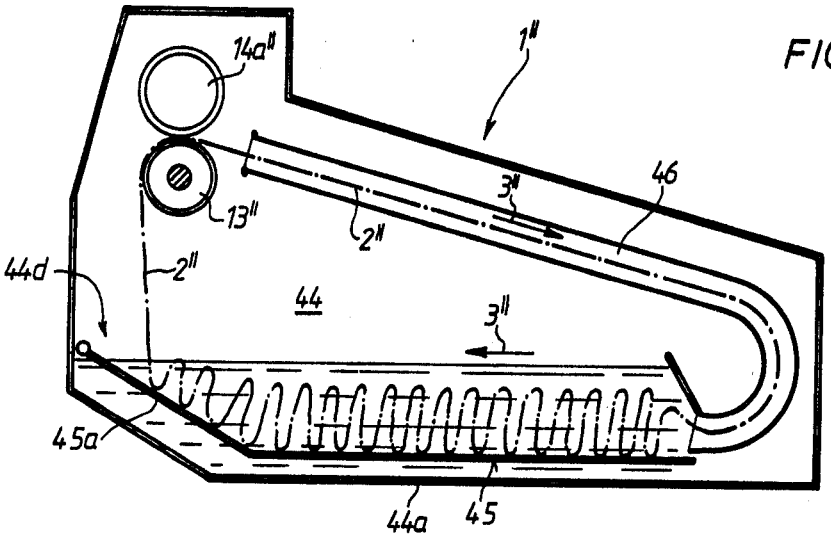
FIG. 4 is a diagrammatic, side elevational view of a further embodiment of wet treatment apparatus in which each chamber has an essentially flat base and the length of material is let down into a chamber with the aid of a rinsing pipe.

Although in the preceding embodiments each chamber is constructed with a concave base, it is, of course, also possible for the base of each chamber to be substantially flat and approximately horizontal. FIG. 4 shows such a construction in a further simplified schematic cross-sectional representation. This wet treatment apparatus 1″ can also contain a number of chambers as has already been described in detail particularly in connection with FIG. 1. The chamber 44 shown in FIG. 4 has an approximately flat horizontal base 44*a* above which a grate 45 (or optionally any suitable type of horizontal conveying apparatus) is arranged at an appropriate distance, and this grate 45 has at the material outlet end 44*d* of the chamber 44 an upwardly inclined section 45*a* which guides the length of material 2″ upwards to the pair of squeeze rollers 13″, 14*a*″. In this case too the grate 45, 45*a* can be suspended like a balance in a manner similar to that described above in connection with FIG. 2.

As a further variation of the embodiments according to FIGS. 1–3, in the wet treatment apparatus 1″ no reel is provided to introduce the length of material into the succeeding chamber, but instead of this the transport means contain individual rinsing pipes 46 in which the length of material 2″ is led from the respective pair of squeeze rollers and passed to the succeeding chamber. Treatment fluid can be introduced or sprayed into each rinsing pipe 46 in a manner which is known per se.

In the other embodiments according to FIGS. 1 and 2 it is also possible to introduce the length of material into the respective succeeding chamber with the aid of such rinsing pipes. Further, in the embodiment according to FIG. 4 the rinsing pipe could be replaced by a corresponding feed roller or reel of the kinds shown in FIGS. 1 and 2.

Figure 5:
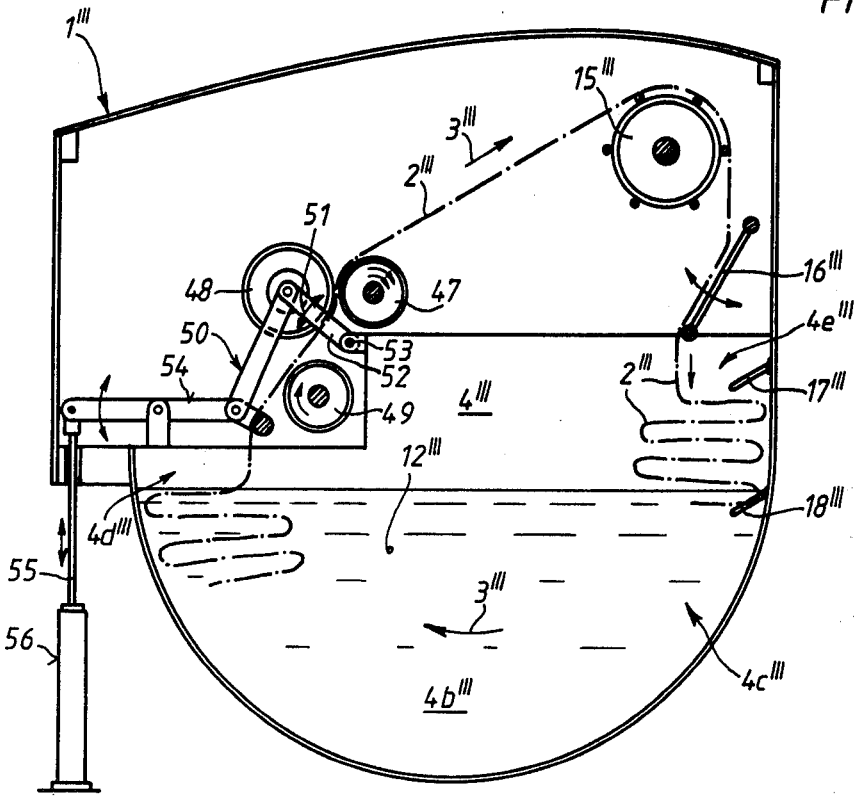
FIG. 5 is a cross-sectional view similar to FIG. 2 but illustrating a further embodiment of the apparatus.

FIG. 5 shows a further embodiment of the wet treatment apparatus. For the sake of simplicity this embodiment is illustrated substantially as a modification of the embodiment according to FIG. 1. For this reason all the parts which are similar in construction to those of FIG. 1 are given the same reference numerals but with the addition of a triple prime; furthermore—as in FIG. 2—only a cross-section in the region of one chamber, namely the chamber 4‴, is shown.

Thus, in this apparatus 1‴ the chamber 4‴ (and each of the chambers) has in its lower part 4*b*‴ a resting zone 4*c*‴ in which the incoming length of material 2‴ can rest before it enters the fluid bath 12‴. In order to be able to monitor and control the quantity of material in this chamber 4‴ in a desired manner corresponding devices are provided—as in the preceding embodiments—which for the sake of simplicity contain two filling level indicators 17‴ and 18‴—corresponding to the example according to FIG. 1—for the maximum and minimum filling level. These filling level indicators 17‴, 18‴ are arranged in a suitable manner in the region of the material inlet end 4*e*‴ of the resting zone 4*c*‴ where the incoming length of material is let down in pleats at 2‴ with the aid of the pivotable pleating frame 16‴.

Whereas in the preceding embodiments only two squeeze rollers (a pair of squeeze rollers) are provided approximately above the material outlet end of each chamber, this apparatus 1''' has three rollers in the region above the material outlet end **4*d'''* of each treatment chamber, namely one fast-running first squeeze roller 47, one non-driven free-running second squeeze roller 48 and a third squeeze roller 49 which is driven more slowly than the first squeeze roller 47. These three squeeze rollers form part of the transport means and are responsible for the conveyance of the length of material 2''' in the direction of the arrow 3'''. Whereas the first squeeze roller 47 and the third squeeze roller 49 which is arranged parallel thereto but at a distance therefrom can be constructed as continuous squeeze rollers which are common to all chambers of the apparatus 1''', in this case the second squeeze roller 48 is constructed separately for each chamber e.g., 4''', in the form of a free-running pressure roller. This second squeeze roller 48 is held in a pivot support 50 in such a way that it can be pivoted on a pivot arm 52 in the directions of the double arrow 51 about a stationary axis 53 either against the first squeeze roller 47 or against the third squeeze roller 49. Furthermore, the pivot support 50 is connected via a multiple-lever arrangement 54 to the piston rod 55 of a cylinder-piston unit 56 which is in turn connected for control purposes to the filling level indicators 17''' and 18'''. In this way the second squeeze roller 48 of each chamber can be controlled by the monitoring devices so as to cooperate in one pivot position with the first squeeze roller 47 and in the other pivot position with the third squeeze roller 49. In the illustrated embodiment (FIG. 5) the combination of the three squeeze rollers 47, 48, 49 is such that the length of material 2'''—viewed in the direction of conveyance of the material (arrow 3''')—is first passed over the third squeeze roller 49 and then over the first squeeze roller 47, while the second squeeze roller 48 is pressed from above against the length of material 2'''. The particular advantage of the embodiment according to FIG. 5 lies in the fact that the rate of conveyance of the material can be altered as a function of the quantity of material determined at any time in the resting zone 4*c'''* (in the region of the filling level indicators 17''', 18''') so that the quantity of material can be influenced or controlled in a desired manner. Above all, a more delicate material can be treated more gently, i.e., if for example an excessive quantity of material is determined at the inlet end 4*e'''* of the chamber 4''', then the conveyance of the length of material 2''' does not have to be completely stopped (putting corresponding strain on the material) but can merely be appropriately slowed down by simple pivoting of the second squeeze roller 48 against the slower-running third squeeze roller 49**. At the same time, however, the rate of conveyance of the length of material can for example be increased in the succeeding treatment chamber.

In this embodiment of the apparatus 1''' it is also preferable to make the speed ratio between the first squeeze roller 47 and the third squeeze roller 49 variable, and it is also possible for at least the third squeeze roller to be constructed separately for each treatment chamber, i.e., not continuous over all chambers. In this way it is possible to set corresponding speed differences between the fast-running first squeeze roller 47 and the slower-running third squeeze roller 49, which is of particular importance when materials of differing weights are running behind one another.

The embodiment of the wet treatment apparatus 1''' described in connection with FIG. 5 can also be combined with the appropriate elements of FIGS. 2 and 3 on the one hand and of FIG. 4 on the other hand; i.e., instead of the filling level indicators 17''', 18''' weighing arrangement (according to FIGS. 2 and 3) could be used, and instead of a transport reel 15''' (optionally with additional elements according to FIGS. 2 and 3) corresponding rinsing pipes could be used.

I claim:

1. Apparatus for controlling the rate of movement of a length of textile material through a series of treatment chambers in each of which is monitoring means for monitoring a predetermined change in the quantity of material therein, said apparatus comprising, for each chamber, rotary guide means for introducing said material into such chamber; a pair of rotary squeeze rolls between which said material may be gripped in being withdrawn from such chamber, one of said squeeze rolls being driven; shift means connected to one of said squeeze rolls and responsive to operation of the monitoring means in such chamber to move such squeeze roll toward and away from the other whereby said squeeze rolls are enabled and disabled to grip said material and withdraw it from such chamber; first material support means adjacent said rotary guide means; second material support means adjacent said squeeze rolls, said first and second support means being operable to support said material when said squeeze rolls are so disabled; and means coupling said first and second material support means to one another and to said shift means for moving said support means into and out of material supporting positions in response to movements of said shift means.

2. Apparatus according to claim 1 wherein said monitoring means comprises means for weighing the quantity of said material present in the associated chamber.

3. Apparatus according to claim 1 wherein said monitoring means comprises a grate in the associated chamber for supporting material therein, said grate being balanced for movements in opposite directions in response to increases and decreases, respectively, in the quantity of material supported thereby.

4. Apparatus according to claim 1 wherein one squeeze roll of said pair is elongate and common to all of said chambers and the second squeeze roll associated with any of said chambers is independent of the second squeeze roll of any other chamber.

5. Apparatus according to claim 4 wherein said shift means is connected to said second squeeze roll.

6. Apparatus according to claim 1 including a driven, third rotary squeeze roll associated with each chamber, said third squeeze roll being driven at a rate of speed different from that at which said one squeeze roll is driven.

7. Apparatus according to claim 6 wherein material withdrawn from any of said chambers follows a path in which it may be gripped between said third squeeze roll and the movable one of said pair of squeeze rolls.

8. Apparatus according to claim 7 wherein said shift means is operable to move the movable one of said pair of squeeze rolls between a first position in which said material is gripped between said movable one of said pair of squeeze rolls and said one squeeze roll, a second position in which said material is gripped between said movable one of said pair of squeeze rolls and said third squeeze roll, and a third position in which said material is not gripped by either of said one or said third squeeze roll.

9. Apparatus according to claim 1 including means for rinsing material in each of said chambers.

10. In apparatus for controlling the rate of movement of a length of textile material in hank form successively through a series of wet treatment chambers in each of which is monitoring means operable to sense a predetermined change in the quantity of material therein, said apparatus including transport means normally operable to withdraw material in succession from each of said chambers and feed such material to the next adjacent chamber at a selected rate of speed, said apparatus also including means responsive to the sensing by said monitoring means of a predetermined decrease in the quantity of material in any one of said chambers to reduce the rate of speed at which material is withdrawn from said one of said chambers, the improvement wherein the monitoring means for each of said chambers comprises a grate on which material is supported; means mounting said grate within said chamber to rise and fall in response to a decrease or an increase, respectively, in the quantity of material supported thereby; actuating means coupled to said grate for movements in response to the rise and fall of said grate; and means responsive to movement of said actuating means a predetermined distance as a result of the fall of said grate to reduce the rate of withdrawal of material by said transport means from the associated chamber.

11. Apparatus according to claim 10 wherein said grate is hinged at one end of rocking movements about a horizontal axis and wherein said actuating means is coupled to said grate at its other end.

12. Apparatus according to claim 10 wherein said transport means comprises a pair of adjacent squeeze rollers one of which is driven and between which rollers said material may be gripped for withdrawal from said chamber, and means mounting the other of said rollers for movement away from the driven one of said rollers in response to said movement of said actuating means.

13. Apparatus according to claim 12 including a driven third squeeze roller, said third roller being driven at a slower rate of speed than said one driven roller, said third roller being mounted in a position to enable said material to be gripped between said third roller and said other roller in response to said movement of the latter away from said one roller.

* * * * *